US005746490A

United States Patent [19]

Domenig

[11] Patent Number: 5,746,490

[45] Date of Patent: May 5, 1998

[54] DRAWER GUIDE SUPPORT BRACKET

[75] Inventor: Georg Domenig, Kernersville, N.C.

[73] Assignee: Grass America, Inc., Kernersville, N.C.

[21] Appl. No.: 720,697

[22] Filed: Oct. 2, 1996

[51] Int. Cl.[6] ..... A47B 88/00

[52] U.S. Cl. ..... 312/334.5; 312/330.1; 312/334.7; 248/201

[58] Field of Search ..... 312/334.7, 334.4, 312/330.1, 334.1, 334.5; 248/201

[56] References Cited

U.S. PATENT DOCUMENTS

| | | | |
|---|---|---|---|
| 4,244,546 | 1/1981 | Mertes et al. | 312/334.5 X |
| 5,039,181 | 8/1991 | Lautenschlager | 312/334.7 |
| 5,257,861 | 11/1993 | Domenig et al. | 312/334.5 |
| 5,359,752 | 11/1994 | Domenig | 312/330.1 X |
| 5,387,033 | 2/1995 | Domenig | 312/330.1 X |
| 5,549,376 | 8/1996 | Domenig | 312/334.5 |
| 5,597,220 | 1/1997 | Domenig et al. | 312/334.4 |
| 5,636,820 | 6/1997 | Domenig | 312/334.5 X |

FOREIGN PATENT DOCUMENTS

| | | | |
|---|---|---|---|
| 4124535 | 1/1993 | Germany | 312/334.5 |

*Primary Examiner*—Peter M. Cuomo
*Assistant Examiner*—James O. Hansen

[57] ABSTRACT

A drawer guide support bracket permits use of a standard length drawer guide in a furniture article, such as a cabinet, and provides a simple and efficient method of securely attaching the support bracket to a face frame member of the cabinet. The support bracket includes a bracket body having a drawer guide receiving portion and a fastening structure for securing the bracket to the face frame member and supporting the drawer guide thereon without decreasing the space needed to accommodate a standard length drawer guide. The support bracket includes a cut-away section within the bracket body for eliminating the interposing thickness of the bracket body between the supported drawer guide and the surface of the face frame member to which the bracket is secured. In another embodiment, the subject invention includes a staple-like support bracket in which the tongue portion of a drawer guide is strapped directly against the inside surface of a rear face frame member by the staple-like support bracket.

18 Claims, 5 Drawing Sheets

DRAWER GUIDE SUPPORT BRACKET

BACKGROUND OF INVENTION

1. Field of Invention

The subject invention is generally related to support brackets for drawers and is specifically directed to a drawer guide support bracket for supporting a drawer guide in a furniture article having face frame members.

2. Description of the Prior Art

In the United States, approximately 95% of cabinets made for use in kitchens are of a type commonly referred to as a peninsula cabinet or island cabinet with a standard front-to-rear outside dimension of approximately 24¾ inches. Such cabinets may be provided with drawer openings defined by face frame members on the front and, for example, a ⅛ inch to ¼ inch solid back wall at the rear of the cabinet.

However, approximately 80% of peninsula or island type cabinets are provided with face frame members on both the front and the rear of the cabinet to define drawer openings at corresponding locations on both the front and the rear of the cabinet. In such case, for economy of space, the cabinet is dimensioned to accommodate only a single drawer inserted into the opening on one of the front and the rear. The particular layout of the room and the position of other cabinets or the like dictates on which side of the cabinet the drawer openings are used to receive drawers. The unused drawer openings on the opposite side are simply covered, for example, with decorative false fronts.

In either case, as mentioned, the over-all-front-to-rear dimension for about 95% of such cabinets is approximately 24¾ inches. In order to provide support for a moveable drawer within the drawer opening, it is necessary to install a horizontally disposed drawer guide in the cabinet. The front end of the drawer guide is attached to one of the face frame members defining the drawer opening which is used for receiving a drawer, with the front edge of the drawer guide positioned flush with the front edge of the drawer opening up to about ⅛ inch rearward of the front edge of the drawer opening.

A type of drawer guide in common use has a rear end opposite its front end with a bent tongue portion which is received and supported by a support bracket affixed to an interior portion of the cabinet opposite the drawer opening which is used for receiving a drawer. In the case of a cabinet provided with a solid back wall, the drawer guide support bracket is mounted on the inside surface of the solid back wall. In the case of a cabinet provided with rear face frame members defining unused drawer openings to be covered with decorative false fronts, the drawer guide support bracket is usually mounted either on the inside surface or on a rear face frame member.

In cabinets provided with a solid back wall, manufacturing considerations dictate, for example, that the solid back wall be spaced up to about ⅜ inch forward of the rear of the cabinet. Thus, the inside surface of the ⅛ inch to ¼ inch thick solid back may be spaced from ½ inch up to about ⅝ inch from the rear of the cabinet. A drawer guide support bracket in common use for mounting on the inside surface of a solid back wall has a bracket base approximately ⅛ inch thick with spring flanges extending above the front surface of the bracket base for receiving the drawer guide tongue portion between the spring flanges and the front surface of the bracket base.

Therefore, a prior art bracket supports the drawer guide with the ⅛ inch thickness of the bracket base interposed between the front surface of the back wall and the rear end of the drawer guide. Consequently, the front surface of the bracket base and the rear end of the supported guide may be disposed from approximately ⅝ inch up to ¾ inch forward of the rear of the cabinet.

It is apparent that with an over-all front to rear outside cabinet of 24¾ inches, the space available to accommodate the length of a horizontally mounted drawer guide between the front edge of the drawer opening and the front surface of a bracket base mounted on the solid back wall of a cabinet can range from approximately 23⅞ inches with the front edge of the drawer guide spaced ⅛ inch rearward of the front edge of the drawer opening and a ¼ inch thick back wall, up to about 24¼ inches with the front edge of the drawer guide flush with the front edge of the drawer opening and a ⅛ inch thick back wall.

In order to avoid purchasing and maintaining inventories of drawer guides of various lengths, cabinet manufacturers have adopted a standard drawer guide length of 24 inches for use in cabinets having a solid back wall. To accommodate a standard 24 inch long drawer guide, cabinet manufacturers simply adjust one or more of the position of the front edge of the drawer guide relative to the front edge of the drawer opening, the thickness of the solid back wall, and the distance by which the solid back wall is spaced forward of the rear of the cabinet.

In other words, the front edge of the drawer guide may be spaced ⅛ rearward of the front edge of the drawer opening with a ⅛ inch thick back wall spaced ⅜ inch forward of the rear of the cabinet and, taking into consideration a ⅛ inch thick bracket base, a 24 inch long drawer guide can be accommodated. On the other hand, the front edge of the drawer guide may be flush with the front edge of the drawer opening with a ¼ inch back wall likewise spaced ⅜ inch forward of the rear of the cabinet and, likewise taking into consideration a ⅛ inch thick bracket base, a 24 inch long drawer guide can likewise be accommodated.

Alternatively, it would be possible, but less preferable, to decrease the ⅜ inch distance by which the back wall is spaced forward of the rear of the cabinet, with complementary adjustments in one or more of the position of the front edge of the drawer guide, the thickness of the back wall and the position of the back wall relative to the rear of the cabinet, to accommodate a 24 inch long drawer guide.

In the case of a cabinet provided with face frame members on the rear of the cabinet defining an unused drawer opening which is to be covered, for example, by a decorative false front, the drawer guide support bracket must usually be mounted on the inside surface of a rear face frame member. In such cabinets, manufacturing considerations dictate that the face frame members be approximately ¾ inch thick. It will be readily apparent that the type of bracket with a ⅛ inch bracket base in common use for mounting on the inside surface of a solid back wall may likewise be used for mounting on the inside surface of such rear face frame members.

However, it will be equally apparent that given an over-all front to rear outside cabinet dimension of 24¾ inches and a rear face frame member thickness of ¾ inch, the maximum space available to accommodate the length of a horizontally mounted drawer guide between the front edge of the drawer opening and the front surface of a ⅛ inch bracket base mounted on the inside surface of a rear face frame member is 23⅞ inches.

It is obvious that the standard 24 inch long drawer guide adopted by manufacturers for use in cabinets with a solid back wall cannot be used under any circumstance with the commonly used type of bracket having a ⅛ inch thick bracket base mounted on the inside surface of a rear face frame member. Rather, a shorter drawer guide must also be purchased and inventoried by cabinet manufacturers for use in such cabinets.

On the other hand, if the ⅛ inch thickness of the bracket base were not interposed between the inside surface of the rear face frame member and the rear end of drawer guide, it can be seen that the standard 24 inch long drawer guide would readily fit in the space provided between the front edge of the drawer opening and the inside surface of a rear face frame member, and the standard 24 inch long drawer guide could be used in both types of cabinets.

Therefore, there is a need for a support bracket which eliminates interposing the ⅛ thickness of the bracket base between the rear end of a drawer guide and the inside surface of a rear face frame member of a cabinet such that the standard 24 inch long drawer guide can be used in both types of cabinets.

SUMMARY OF THE INVENTION

The subject invention is directed to a drawer guide support bracket for securely supporting a drawer guide in a furniture article, such as a cabinet, without decreasing the length of the space needed to accommodate a standard length drawer guide. The support bracket of the subject invention is specifically designed for use with cabinets of the type having both front and rear face or frame members with the face frame members on the rear of the cabinet defining an unused drawer opening which is typically covered, for example, by a decorative false front. The drawer guide support bracket is designed to be secured to the inside surface of a rear face frame member for supporting a horizontally disposed drawer guide in a cabinet and is illustrated in three preferred embodiments.

All of the illustrated embodiments serve to provide a simple and efficient method of securely attaching the support bracket to a face frame member of a cabinet while allowing a standard length drawer guide to be utilized in cabinets having both front and rear face frame members which are approximately ¾ inches thick. Each of the preferred embodiments of the drawer guide support bracket include a bracket body, a drawer guide receiving portion on the bracket body and a bracket fastening means extending from the bracket body for attaching the support bracket to an inside surface of a rear face frame member.

In the first and second preferred embodiments, the drawer guide support bracket of the subject invention comprises a bracket body including a bracket base with a front and rear portion and a cut-away section in the rear portion of the base. As is typical, the bracket base is approximately ⅛ inch thick and includes a bracket fastening means for mounting the bracket inside a furniture article. In the first and second preferred embodiments, the bracket fastening means is a depending ledge provided on the back side of the bracket adapted to fasten the bracket to a rear face frame member. The depending ledge includes a means for attachment, such as, a through hole in the ledge and a corresponding fastener to be inserted into the through-hole for securing the bracket to the face frame member. The preferred support bracket may also include a brace wall extending from the depending ledge for providing additional support to the drawer guide support bracket.

It is a feature of the subject invention that a section of the rear portion of the base is cut away and the depending ledge is positioned to secure the bracket to the face frame member such that the cut-away section of the rear portion of the base is directly adjacent to the surface of the supporting face frame member. Omission of a section of the rear portion of the bracket base eliminates interposing the ⅛ inch thickness of the bracket base between the inside surface of the rear face frame member and the supported end of the drawer guide.

The support bracket of the first illustrated embodiment includes a front wall, a back wall and opposite sides, and is provided with opposing spring flanges extending above the front wall of the base for receiving a bent tongue portion of a standard length drawer guide between the spring flanges and the front wall of the bracket base. The cut-away section in the rear portion of the base forms an opening extending through the front and back walls of the bracket such that the front wall of the secured bracket is flush with the surface of the rear face frame member on which it is mounted.

In the first embodiment, the depending ledge of the support bracket extends from the back wall of the bracket, substantially across the width of the rear portion of the base, and is positioned for mounting the bracket to a vertical side edge of a rear face frame member. When the bracket is secured to the vertical side edge of a face frame member, the opposing spring flanges on the bracket are horizontally positioned to receive the bent tongue portion of the drawer guide to be supported in the cabinet. In a variation of the first embodiment, the ledge extends substantially along the length of one side of the base and is positioned for mounting the bracket to a horizontal top or bottom edge of a rear face frame member. While the ledge is repositioned for mounting on a horizontal face frame member, the opposing spring flanges remain horizontally positioned for receiving the bent tongue portion of a horizontally disposed drawer guide.

The second embodiment of the drawer guide support bracket of the subject invention is not provided with spring flanges but likewise has a section of the rear portion of the bracket base cut away and likewise has a depending ledge on the back side of the bracket. The drawer guide receiving portion is a chamber adapted to receive end of the drawer guide. In the second embodiment, the depending ledge is provided for fastening the bracket to a rear face frame member, specifically either the horizontal top edge or bottom edge of the rear face frame member. As in the first embodiment, the omission of a portion of the bracket base eliminates interposing the ⅛ inch thickness of the bracket base between the inside surface or the rear face frame member and the rear end of the drawer guide.

The support bracket of the third illustrated embodiment comprises a substantially u-shaped bracket base which simply straps the bent tongue portion of the drawer guide directly against the inside surface of a rear face frame member to support the drawer guide thereon. The substantially u-shaped bracket base includes a top portion having opposite side walls with the bracket fastening means extending from the bottom end of each of the side walls. When secured to the face frame member, the u-shaped bracket forms an opening between the base and the surface of the face frame member to define the drawer guide receiving portion of the bracket. In the third embodiment, the bracket fastening means are dowels extending downward from the bottom ends of the side walls to engage the face frame member and securely attach the bracket to the member. Thus, the support bracket works like a staple to secure the drawer guide directly against the inside surface of a face frame member thereby eliminating the interposing ⅛ inch thickness of the base heretofore positioned between the surface of the rear face frame member and the supported end of the drawer guide.

Therefore, it is an object and feature of the subject invention to provide a drawer guide support bracket for securely supporting a drawer guide having a bent tongue end in a furniture article, such as a cabinet, without decreasing the length of the space needed to accommodate a standard length drawer guide.

It is a further object and feature of the subject invention to provide a drawer guide support bracket having a bracket body designed to be used with cabinets of the type having both front and rear face frame members and the drawer guide support bracket being secured to the inside surface of a rear face frame member for supporting a horizontally disposed drawer guide in a cabinet.

It is another object and feature of the subject invention to provide a drawer guide support bracket having a bracket base including a front portion and a rear portion having a cut-away section for supporting a drawer guide on the inside surface of the face frame member without interposing the bracket body between the supported drawer guide and the inside surface of the face frame member.

It is yet another object and feature of the subject invention to provide a drawer guide support bracket which is mountable on either a vertical side edge of a rear face frame member or a horizontal top or bottom edge of a rear face frame member.

It is a further object and feature of the subject invention to provide a drawer guide support bracket which includes a drawer guide receiving portion on the front portion and a depending ledge extending from the back side of the bracket for mounting the support bracket on the rear face frame member.

It is yet another object and feature of the subject invention to provide a drawer guide support bracket which has a substantially u-shaped base for strapping the bent tongue portion of the drawer guide directly against the inside surface of a rear face frame member to support the drawer guide thereon.

DETAILED DESCRIPTION OF THE DRAWINGS

FIGS. 1–5 illustrate the prior art drawer guide support bracket for supporting a drawer guide in a furniture article, such as a cabinet. The drawer guide is typically used in cabinets having an interior, solid back wall with the support bracket mounted on the inside surface of the back wall (See FIGS. 1–2). The prior art drawer guide support bracket has a solid bracket base with spring flanges extending above the front surface of the bracket base and fastening dowels extending from the back wall of the base to secure the bracket to the back wall in the interior of the cabinet (See FIGS. 3–4).

Figure 1:
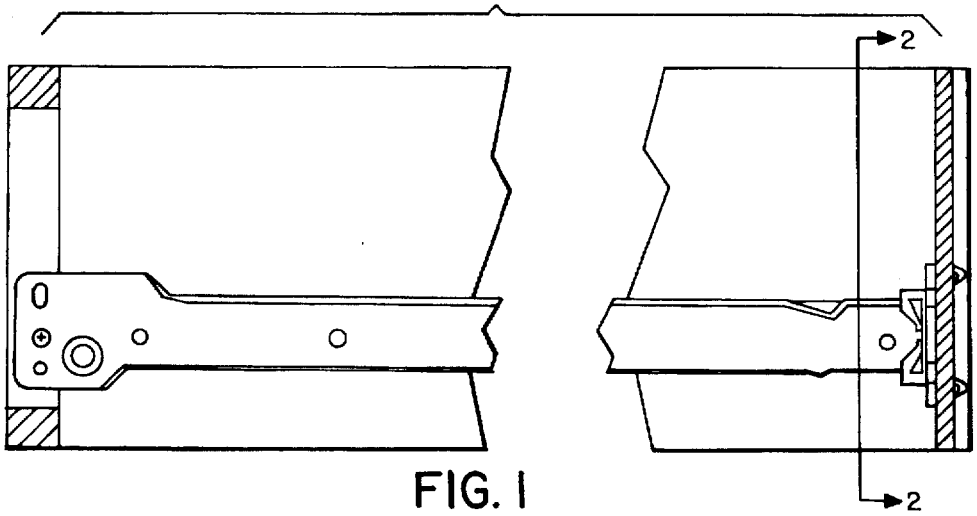
FIG. 1 (PRIOR ART)
FIG. 1 (PRIOR ART) is a side view of a drawer guide in a cabinet with the rear end of the drawer guide supported by a support bracket mounted to the solid back wall of the cabinet.
Figure 2:
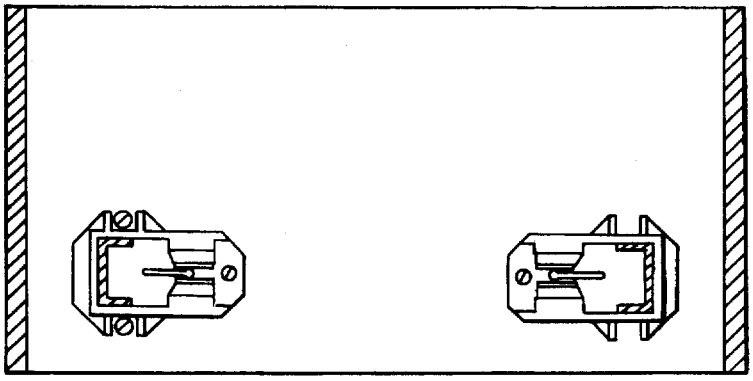
FIG. 2 (PRIOR ART)
FIG. 2 (PRIOR ART) is a front view along line 2—2 of FIG. 1 showing the inside surface of the solid back wall of the drawer opening of the cabinet and two drawer guides mounted on the inside surface of the back wall for supporting the drawer guides on either side of a drawer.
Figure 3:
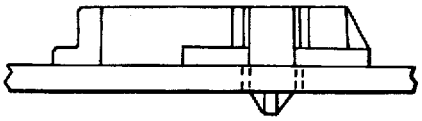
FIG. 3 (PRIOR ART)
FIG. 3 (PRIOR ART) is an enlarged partial view of the support bracket showing a fastening dowel extending from the bracket and through a solid wall to mount the bracket to the wall.
Figure 4:
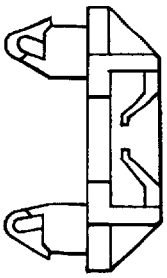
FIG. 4 (PRIOR ART)
FIG. 4 (PRIOR ART) is a side view of the support bracket showing the base of the bracket with spring flanges extending above the front surface of the base and the fastening dowels extending behind the base.
Figure 5:
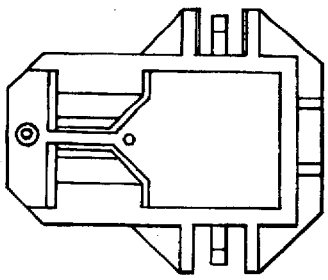
FIG. 5 (PRIOR ART)
FIG. 5 (PRIOR ART) is an overhead view of the support bracket showing the base of the bracket.

As best seen in FIG. 5, the prior art support bracket has a front portion including the spring flanges and a rear portion with a solid bracket base throughout the front and rear portions which typically has a thickness of approximately ⅛ inch. The support bracket is designed to be used with a common type of drawer guide which has a rear end opposite its front end with a bent tongue portion to be received and supported by the support bracket. In use, the prior art support bracket supports the drawer guide with the ⅛ inch thickness of the bracket base interposed between the front surface of the back wall and the rear end of the drawer guide.

The over-all front to rear outside dimensions of 24¾ inches of a standard cabinet having a back wall spaced from ½ inch to ⅝ inch from the rear of the cabinet can easily accommodate the 24 inch length of a standard drawer guide and the ⅛ inch thickness of the drawer guide support bracket. However, in a cabinet including front and rear face frame members of ¾ inches, it is apparent that a standard length drawer guide of 24 inches plus the ⅛ inch thick support bracket mounted on the frame cannot be accommodated in a standard cabinet with the dimensions of 24¾ inches. Thus, while the prior art drawer guide support bracket works to support a drawer guide in a cabinet, one problem is that the interposing thickness of the bracket base between the mounting surface and the drawer guide prevents standard length drawer guides from being used in cabinets with both front and rear face frame members. One solution is for manufacturers to purchase and inventory shorter drawer guides for use in these types of cabinets. However, this solution is not cost effective and manufacturers would prefer to utilize their current inventories of standard drawer guides.

The drawer guide support bracket of the subject invention addresses the problem by eliminating the interposing ⅛ thickness of the bracket base between the rear end of the drawer guide and the face frame member such that the standard 24 inch long drawer guides can be used in any cabinet.

FIGS. 6 to 11 represent the first preferred embodiment of the invention. FIGS. 12 to 16 represent the second preferred embodiment of the invention and FIGS. 17–21 represent the third preferred embodiment of the invention. Each of the illustrated embodiments shows a support bracket designed for use in a furniture article, such as a cabinet 24 having rear face frame members 26, for supporting a drawer guide on the inside surface of the face frame member without interposing the bracket body between the supported drawer guide and the inside surface of the face frame member.

In the first and second preferred embodiments, a drawer guide support bracket 30 comprises a bracket body including a bracket base 32. The bracket base 32 includes a front portion 34, a rear portion 36 and a cut-away section 38 in the rear portion of the base 32. When secured, the cut-away section 38 eliminates the rear portion 36 of the base 32 which would have been interposed between the inside surface of the face frame member and the supported drawer guide; thus the cut-away section 38 is a feature of the invention. In each of the embodiments, the support bracket is designed for use with a drawer guide 40 of the type having a front end 42 and a rear end 44, opposite the front end 42, which includes a bent tongue portion to be received by the support bracket 30. The support bracket 30 of the first and second embodiments includes a drawer guide receiving portion located on the front portion 34 of the base 32 for receiving the bent tongue portion of the drawer guide 40.

The bracket 30 is secured to the inside surface of a face frame member by a bracket fastening means. In the first and second preferred embodiments, the bracket fastening means is a depending ledge 46 which extends from the back side of the base 32 and is substantially perpendicular to the base 32. In use, the depending ledge 46 is placed directly against a face frame member 26 and mounted thereon for securing the bracket 30 in the cabinet. As shown, the depending ledge 46 includes a means for attaching the ledge to a face frame member 26, such as, a through hole 48 in the ledge 50 for receiving a fastener, such as a screw 50, which is inserted into the hole 48 for securing the bracket. While a screw 50 is shown herein to secure the depending ledge 46, it will be understood that any suitable means of attachment for securing the ledge 46 of the bracket 30 to a face frame member may be used. The support bracket 30 may also include a brace wall 52 which extends from the depending ledge 46 to provide additional support to the drawer guide support bracket 30 and supported drawer guide.

Figure 6:
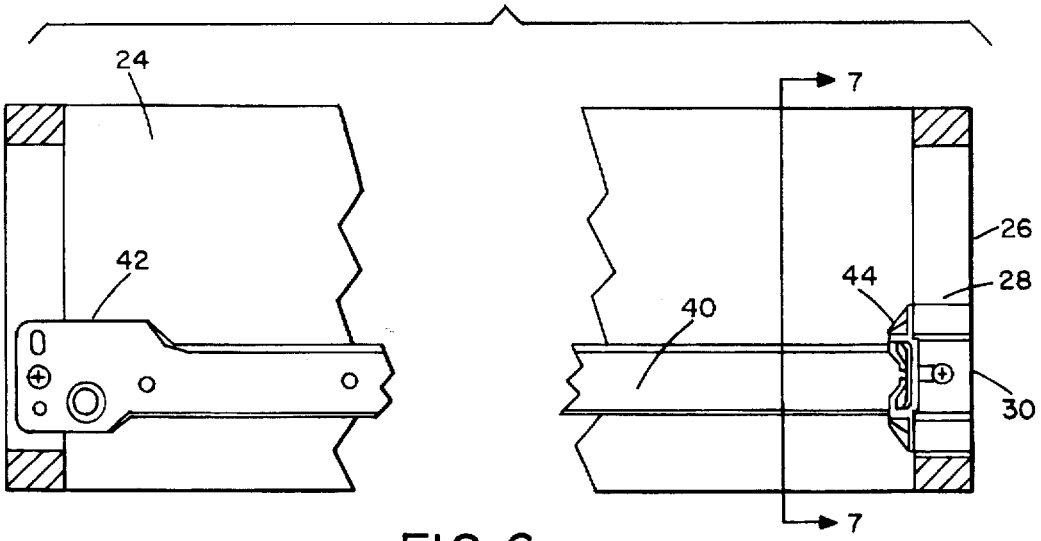
FIG. 6 is a side view of a drawer guide support bracket supporting a horizontally disposed drawer guide in a cabinet having rear face frame members with the support bracket secured to a vertical side rear face frame member and supporting the drawer guide without interposing the bracket between the rear end of the drawer guide held by the bracket and the face frame member.
Figure 7:
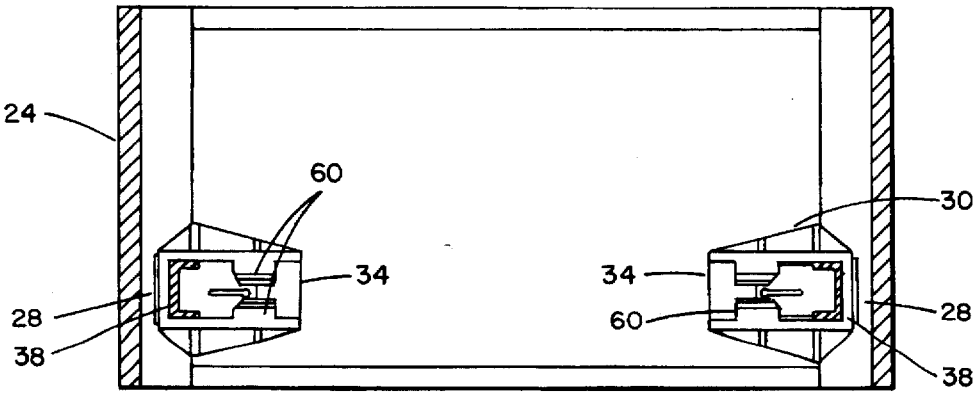
FIG. 7 is a front view along line 7—7 of FIG. 6 showing the rear face frame members of a drawer opening in a cabinet and a drawer guide support bracket mounted to the inside surface of the vertical side rear face frame members on either side of the drawer opening for supporting the drawer guides.
Figure 10:
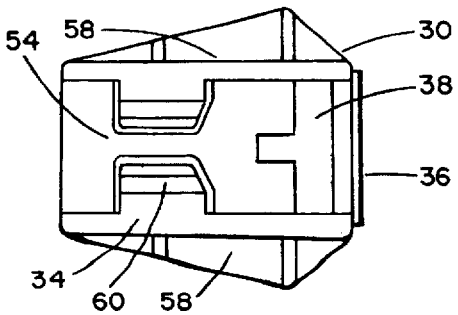
FIG. 10 is an overhead view of the drawer guide support bracket illustrating the opposing flanges in the front portion of the bracket for receiving the end of the drawer guide and a cutaway section in the rear portion which eliminates the rear portion of the bracket interposed between the inside surface of the face frame member and the supported drawer guide.
Figure 11:
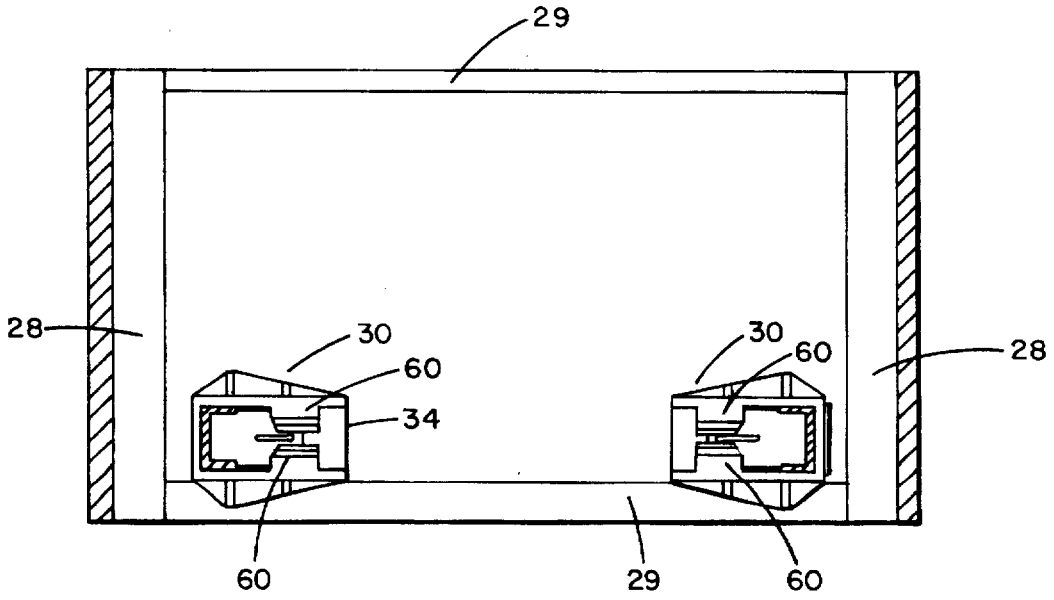
FIG. 11 is a front view of a drawer opening in the cabinet showing the rear face frame members and a variation of the drawer guide support bracket which is mounted to the inside surface of the horizontal bottom rear face frame members for supporting a drawer guide on either side of the drawer.

Referring now specifically to FIGS. 6–11, a drawer guide support bracket 30 of the first embodiment is designed to be mounted to a vertical side rear face frame member 28 for supporting a horizontally disposed drawer guide 40. The support bracket 30 includes a front wall 54, a back wall 56 and opposite sides 58. As is typical, the thickness of the base 32 is approximately ⅛ inch and is defined by the front and back walls 54, 56 of the base 32. The drawer guide receiving portion in the first embodiment is opposing spring flanges 60 extending above the front wall 54 of the base 32 for receiving the bent tongue portion of the drawer guide 40 (See FIG. 9). When the support bracket is secured to the vertical side edge of a face frame member 28 as shown in FIGS. 6–7, the cut-away section 38 in the rear portion 36 of the base 32 forms an opening in the base 32 extending through the front and back walls 54, 56 such that the front wall 54 of the secured bracket is flush with the surface of the rear face frame member 28 on which it is mounted. As best seen in FIG. 10, the cut-away section 38 of the preferred embodiment is a rectangular-shaped opening in the rear portion 36 of the base 32.

Figure 8:
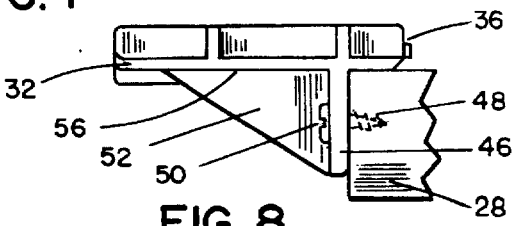
FIG. 8 is a side view of the drawer guide support bracket mounted to a face frame member showing the depending ledge on the back side of the bracket for securing the bracket such that a cutaway section in the rear portion of the bracket is positioned against the inside surface of the face frame member.
Figure 9:
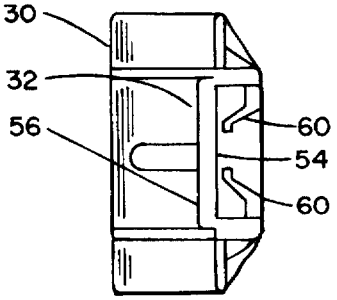
FIG. 9 is a side view of the support bracket showing a bracket base, opposing spring flanges extending above the front wall of the base for receiving the rear end of a drawer guide and the depending ledge extending from the back wall of the base.

As shown in FIG. 8, the depending ledge 46 extends from the back wall 56 of the base 32 and includes a through hole 48 for receiving a screw 50 in the ledge 46 and securing the bracket to a face frame member 28. In the first preferred embodiment, a brace wall 52 extends from the depending ledge 46 to each side of the bracket on the back wall 56 of the front portion 34 of the base 32 to form two triangular-shaped supporting walls (See FIG. 8). Thus, the support bracket 30 of the subject invention provides additional supports for securing the drawer guide support bracket and drawer guide supported thereon in the cabinet.

In the first embodiment, the depending ledge 46 of the support bracket 30 is located on the back wall 56 of the bracket 30 to extend across the width of the rear portion 36 of the base and is positioned for mounting the bracket 30 to the vertical side edges of the rear face frame members, as shown in FIG. 7. When the bracket 30 is secured to the vertical side edge of a face frame member 28, the opposing spring flanges 60 on the bracket 30 are horizontally positioned to receive the bent tongue portion of the drawer guide to be supported in the cabinet. In a variation of the first embodiment shown in FIG. 11, the depending ledge 46 extends substantially along the length of one side 58 of the base 32 and is positioned for mounting the bracket to a horizontal top or bottom edge of a rear face frame member 29. While the ledge 46 is repositioned for mounting on a horizontal face frame member 29 rather than a vertical side face frame member 28, the opposing spring flanges 60 remain horizontally positioned as before for receiving the bent tongue portion of a horizontally disposed drawer guide.

Figure 12:
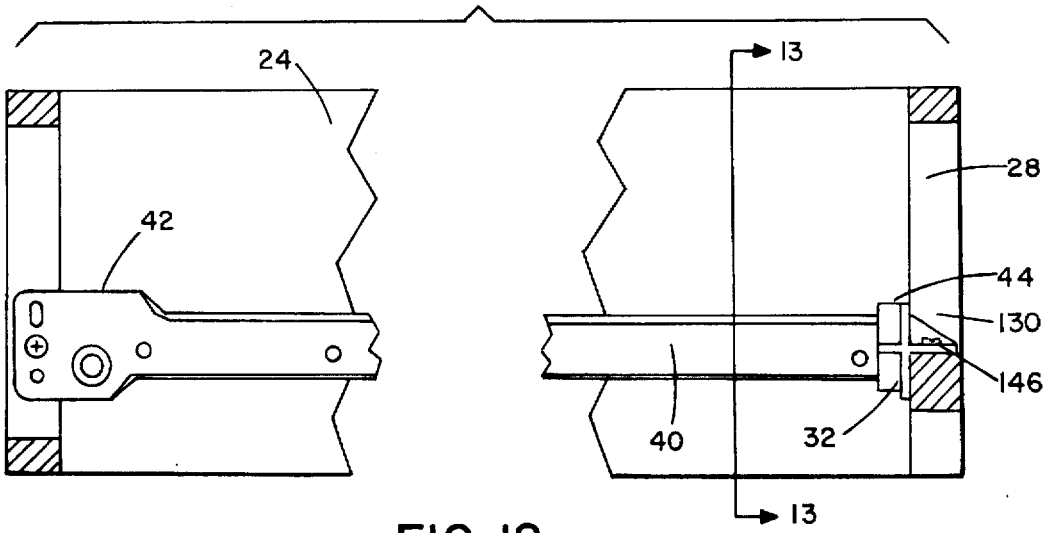
FIG. 12 is a side view of another embodiment of the drawer guide support bracket supporting a horizontally disposed drawer guide in a cabinet having rear face frame members with the support bracket secured to a horizontal bottom rear face frame member and supporting the drawer guide without interposing the bracket between the supported drawer guide and the face frame member.
Figure 13:
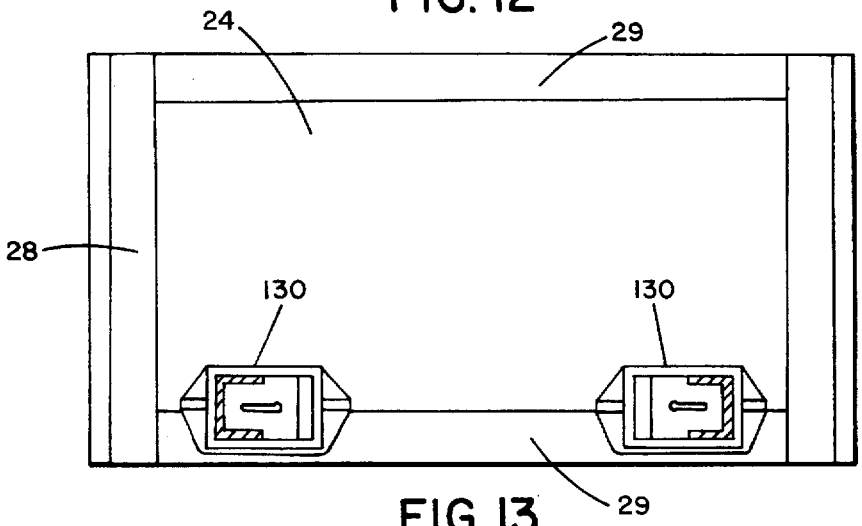
FIG. 13 is a front view along line 13—13 of FIG. 12 showing the rear face frame members of a drawer opening in a cabinet and a drawer guide support bracket mounted to the inside surface of the horizontal bottom rear face frame members for supporting a drawer guide on either side of the drawer.
Figure 15:
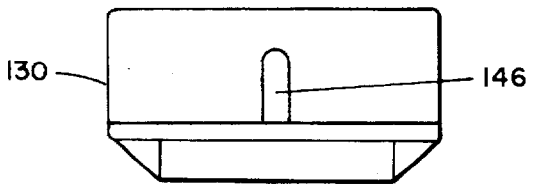
FIG. 15 is a front view of the back end of the drawer guide support bracket showing the depending ledge for securing the bracket.

Referring now specifically to FIGS. 12–16, the drawer guide support bracket 130 of the second embodiment is similar to the first embodiment yet is designed to be mounted to a horizontal top or bottom edge of a rear face frame member 29 for supporting a horizontally disposed drawer guide 40 (See FIGS. 12–13). The bracket base of second embodiment includes a bracket base 132, a front portion 134, a rear portion 136, a top wall 154 and a bottom wall 156. As in the first embodiment, the support bracket of the second embodiment includes a cut-away section 138 in the rear portion 136 of the base 132 which is a feature of the subject invention which eliminates the rear portion 136 of the base 132 which would have been interposed between the inside surface of the face frame member and the supported drawer guide.

Figure 14:
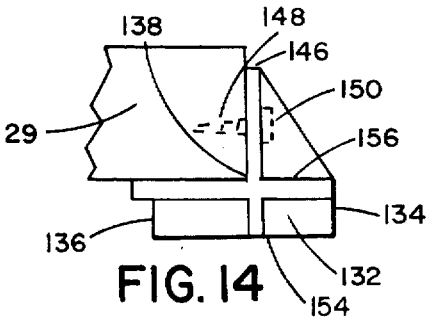
FIG. 14 is a side view of the drawer guide support bracket mounted to a face frame member showing the depending ledge extending from the bracket for securing the bracket such that a cut-away section in the rear portion of the bracket is positioned against the inside surface of the face frame member.
Figure 16:
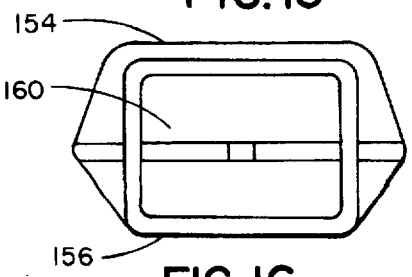
FIG. 16 a front view of the front end of the drawer guide showing the chamber for receiving the drawer guide end.
Figure 17:
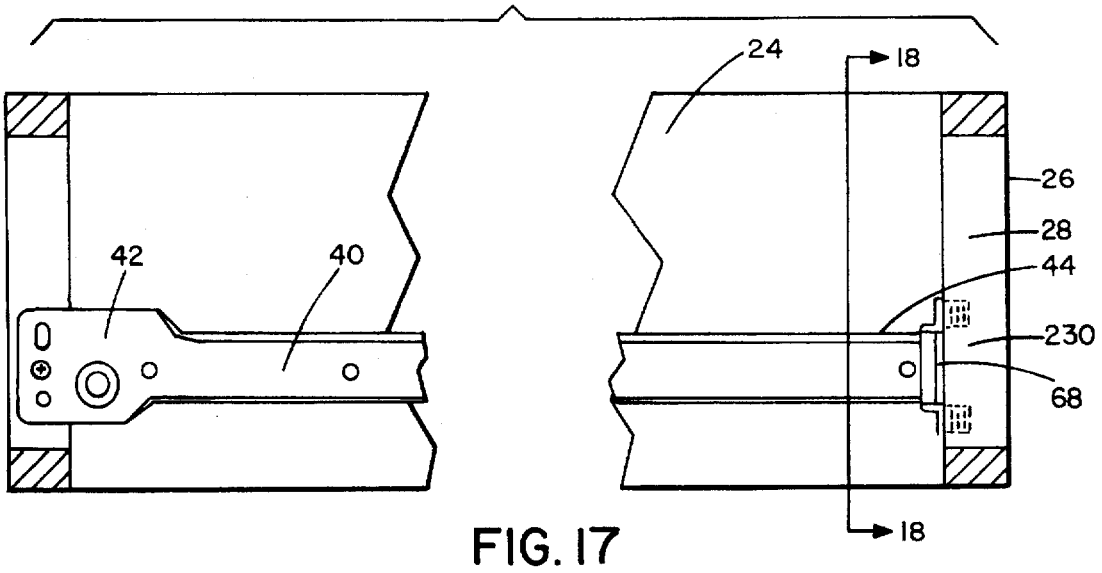
FIG. 17 is a side view of another embodiment of the drawer guide support bracket supporting a horizontally disposed drawer guide in a cabinet having rear face frame members with the staple-like support bracket secured to a vertical side rear face frame member and strapping drawer guide directly to the inside surface without interposing the bracket between the supported drawer guide and the face frame member.
Figure 18:
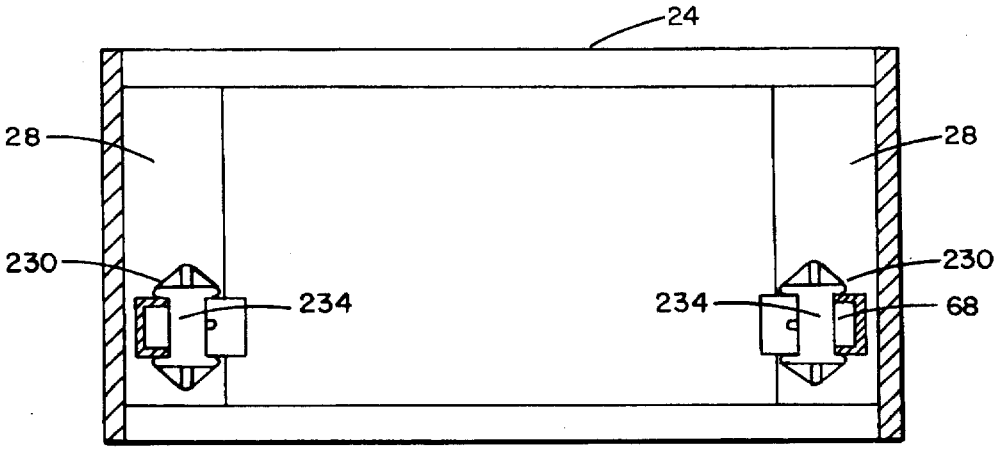
FIG. 18 is a front view along line 18—18 of FIG. 17 showing the rear face frame members of a drawer opening in a cabinet and a drawer guide support bracket mounted to the inside surface of the vertical side rear face frame members for supporting a drawer guide on either side of the drawer.
Figure 19:
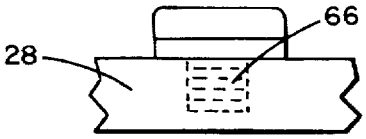
FIG. 19 is an enlarged cross-sectional view of the fastening dowel of the support bracket for mounting the bracket to the face frame member.

As best seen in FIG. 14, the depending ledge 146 extends downward, substantially perpendicular, to the bottom wall 156 for securing the bracket to a horizontal face frame member 29. In use, the depending ledge 146 is placed directly against a horizontal face frame member 29 and mounted thereon for securing the bracket 130 in the cabinet. As shown in FIG. 14, the depending ledge 146 includes a through hole 148 in the ledge 146 for receiving a screw 150 which is inserted into the hole 148 and into the face frame member 29 for securing the bracket 130. In the second embodiment, the drawer guide receiving portion on the base 132 is a chamber 160 designed to receive the bent tongue portion of the drawer guide being supported by the support bracket 130.

Referring now specifically to FIGS. 17–21, the third embodiment of the subject invention provides a unique, substantially u-shaped drawer guide support bracket 230 which simply straps the bent tongue portion of the drawer guide being supported by the support bracket 230 directly against the inside surface of a rear face frame member 28, similar to a staple. As in the first and second embodiments, the third embodiment provides a support bracket which eliminates the interposing ⅛ thickness of the bracket base between the rear end of the drawer guide and the face frame member such that the standard 24 inch long drawer guides can be used in cabinets having both front and rear face frame members.

Figure 20:
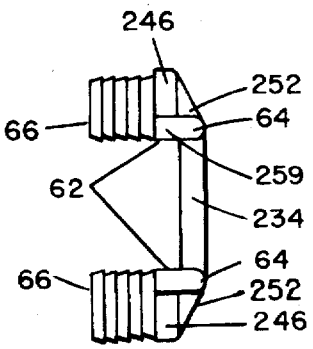
FIG. 20 is a side view of the drawer guide support bracket illustrating the u-shaped bracket base which straps the rear end of the drawer guide directly to the face frame member.
Figure 21:
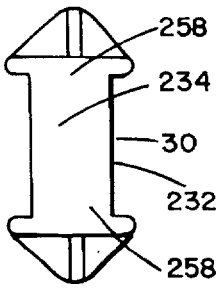
FIG. 21 is an overhead view of the drawer guide support bracket showing the depending ledge extending from either side of the bracket and including brace walls.

The support bracket 230 of the third illustrated embodiment comprises a substantially u-shaped bracket base 232 which includes a top portion 234 having opposite sides 258 and a side wall 259 extending from each side 258 of the top portion 234 (See FIG. 20). Each side wall 259 includes a bottom end 62 and a top end 64 which is secured to the top portion 234 of the base 232. In the preferred embodiment, the top ends 64 are integrally secured to the top portion 234 of the base 232 and bracket fastening means extend from the bottom ends 62 to engage the rear face frame members 28. When secured, an opening 68 is formed between the support bracket base 232 and the surface of the face frame member 28 to define the drawer guide receiving portion.

The bracket base 232 also includes a depending ledge 246 extending outward from the bottom end 62 of each of the side walls 259 such that the depending ledge 246 and adjacent side wall 259 form a substantially L-shaped member. In the preferred embodiment, the bracket fastening means are dowels 66 extending downward from the bottom ends 62 of the L-shaped member formed by the side wall 259 and adjacent depending ledge 246. Further, the bracket base 232 may include a brace wall 252 extending from each depending ledge 246 to the top end 64 of each side wall 259 of the bracket base 232 for providing additional support to the support bracket 230.

While specific embodiments and features of the invention have been disclosed herein, it will be readily understood that the invention encompasses all enhancements and modifications within the scope and spirit of the following claims.

What is claimed is:

1. A support bracket for supporting a drawer guide on an inside surface of a face frame member of a furniture article, said support bracket comprising:

a bracket body:

a drawer guide recieving portion on the bracket body;

a bracket fastening means extending from the bracket body and adapted to secure the bracket body to the inside surface of the face frame member; said bracket body having a bracket base with a front portion and a rear portion and a cut-away section in the rear portion of the base, wherein the bracket fastening means is adapted to secure the cut-away section of the rear portion of the base against the inside surface of the face frame member;

said bracket fastening means including a depending ledge extending from the base and adapted for fastening the bracket body to the face frame member; and the bracket base having a front wall, a back wall and opposite sides, said front and back walls together defining a predetermined thickness of the base, and said drawer guide receiving portion being positioned on the front portion of the base, wherein said cut-away section in the rear portion of the base forms an opening extending through the front and back walls;

wherein the bracket body is adapted to be secured to the face frame member with the front wall of the bracket base flush with the inside surface of the face frame member, and wherein said cut-awayt section is adapted to eliminate interposing the rear portion of the bracket base between the inside surface of the face frame member and the drawer guide.

2. The support bracket as claimed in claim 1, wherein said depending ledge extends outward from the back wall of the base and is substantially perpendicular to the back wall.

3. The support bracket as claimed in claim 2, said bracket base having a width extending from one side to the other side of the base, said ledge extending substantially across the width of the rear portion of the base, wherein said bracket body is adapted to be secured to the face frame member with the drawer guide receiving portion in a horizontally disposed position.

4. The support bracket as claimed in claim 2, said bracket base having a length extending from the front portion to the rear portion of the base, said ledge extending substantially along the length of the base, wherein said bracket body is adapted to be secured to the face frame member with the drawer guide receiving portion in a horizontally disposed position.

5. The support bracket as claimed in claim 1, said drawer receiving portion comprising opposing spring flanges extending above the front wall of the base.

6. The support bracket as claimed in claim 5, wherein said opposing spring flanges are each secured to the base and each has an upstanding side section integrally secured to the opposite sides of the base.

7. The support bracket as claimed in claim 1, said bracket base further comprising at least one brace wall extending from the depending ledge to the back wall of the bracket base for providing additional support to the support bracket.

8. The support bracket as claimed in claim 7, said brace wall comprising a first and second brace wall on opposite sides of the base, said walls extending diagonally from the depending ledge to the front portion of the bracket base.

9. The support bracket as claimed in claim 1, said depending ledge further including an attachment means for securing the ledge to a face frame member.

10. The support bracket as claimed in claim 9, wherein said attachment means includes a through-hole in the ledge and a fastener to be inserted into the through-hole and adapted for securing the ledge to a face frame member.

11. A drawer support combination for supporting a drawer in a furniture article having face frame members, said drawer support combination comprising:

a drawer guide having a front end and a rear end opposite the front end, said rear end including a bent tongue portion;

a support bracket having a bracket body;

a tongue receiving end on the bracket body;

a bracket fastening means extending from the bracket body and adapted to secure the support bracket to an inside surface of the face frame member:

said bracket body having a bracket base with a front portion and a rear portion and a cut-away section in the rear portion of the bracket base, wherein said tongue receiving end is on the front portion of the base for receiving the bent tongue portion of the drawer guide;

wherein said bracket fastening means is adapted to secure the cut-away section of the rear portion of the base against an inside surface of the face frame member, and wherein said cut-away section is adapted to eliminate interposing the rear portion of the bracket base between the inside surface of the face frame member and the drawer guide.

12. A drawer support combination for supporting a drawer in a furniture article, said drawer support combination comprising:

a. face frame members including horizontally and vertically disposed members in a furniture article and defining a drawer opening;

b. a drawer guide having a front end and a rear end opposite the front end, said rear end including a bent tongue portion;

c. a support bracket for supporting the drawer guide, said support bracket including a bracket body having a front and rear portion;

d. a tongue receiving end on the bracket body for receiving the bent tongue portion of the drawer guide;

e. a cut-away section in the rear portion of the bracket base, wherein said tongue receiving end is on the front portion of the base;

f. a bracket fastening means extending from the bracket body for securing the support bracket to the inside surface of the face frame members; and g. wherein the bent tongue portion of the supported drawer guide is directly adjacent to the face frame member and the bracket body of the secured support bracket is not interposed between the tongue portion and the inside surface of the face frame member.

13. The drawer support combination as claimed in claim 12, wherein said face frame members include rear vertical face frame members, each member having a vertical side edge.

14. The drawer support combination as claimed in claim 13, wherein said bracket fastening means is secured to the rear vertical face frame member.

15. The drawer support combination as claimed in claim 12, wherein said face frame members include a top rear horizontal face frame member and a bottom rear horizontal face frame member, each member having an edge.

16. The drawer support combination as claimed in claim 15, wherein said bracket fastening means is secured to either the edge of the top rear face frame member or the edge of the bottom rear face frame member.

17. The drawer support combination as claimed in claim 12, wherein said bracket fastening means is a depending ledge extending from the bracket body for securing the support bracket to the face frame members.

18. A support bracket for supporting a drawer guide in an furniture article, comprising:

a bracket body, the bracket body having a bracket base with a front portion and a rear portion and a cut-away section in the rear portion of the bracket base, the bracket base having a front wall, a back wall and opposite sides, and the cut-away section in the rear portion of the bracket base forming an opening extending through the front and back walls;

a drawer guide receiving portion positioned on the front wall of the bracket base and being adapted to support the drawer guide;

a bracket fastening means extending from the bracket body, the bracket fastening means including a depending ledge extending from and substantially perpendicular to the back wall of the bracket base and adapted for fastening the bracket body to the furniture article.

* * * * *